United States Patent [19]

Sawaoka et al.

[11] 4,087,170

[45] May 2, 1978

[54] ELECTROSTATIC COPYING APPARATUS WITH COMBINED CHARGING TRANSFER UNIT

[75] Inventors: Eiji Sawaoka, Zama; Shinichi Hashimoto, Fujisawa, both of Japan

[73] Assignee: Tokyo Shibaura Electric Co., Ltd., Kawasaki, Japan

[21] Appl. No.: 694,435

[22] Filed: Jun. 9, 1976

[30] Foreign Application Priority Data

Jun. 13, 1975 Japan ..... 50/71716
Jun. 13, 1975 Japan ..... 50/80524[U]

[51] Int. Cl.[2] ..... G03G 15/16

[52] U.S. Cl. ..... 355/3 CH; 355/3 TR; 355/15

[58] Field of Search ..... 355/3 R, 3 CH, 3 TR, 355/3 DD, 8, 11, 14, 15

[56] References Cited

U.S. PATENT DOCUMENTS 3,647,293 3/1972 Queener ..... 355/15
3,918,808 11/1975 Narita ..... 355/14 X

OTHER PUBLICATIONS

"Copier with Single Corona Generating Device", Xerox Disclosure Journal, Feb. 1976, p. 93.

*Primary Examiner*—A. D. Pellinen
*Attorney, Agent, or Firm*—Cushman, Darby & Cushman

[57] ABSTRACT

An electrostatic copying apparatus comprising a rotatable drum having a photosensitive layer formed on the circumferential surface, the drum making two rotations for performing a series of copying functions including charging, exposure, development, transfer, discharge and cleaning. Charging exposure and development are effected in the first rotation of the drum, and transfer, discharge and cleaning in the second rotation. At least, a unit serving for both charging and transfer functions is incorporated in the apparatus.

12 Claims, 2 Drawing Figures

ELECTROSTATIC COPYING APPARATUS WITH COMBINED CHARGING TRANSFER UNIT

This invention relates to an electrostatic copying apparatus, particularly, to an electrostatic copying apparatus having a rotatable drum on the circumferential surface of which a photosensitive layer is formed.

A prior art electrostatic copying apparatus comprises a charging unit, an exposure unit, a development unit, a transfer unit, a discharge unit and a cleaning unit arranged round a rotatable drum in the order mentioned relative to the rotation direction of the drum. A series of copying functions including charging, exposure, development, transfer, discharge and cleaning are effected during one complete rotation of the drum. What should be noted here is that a number of units each corresponding to the series of copying functions mentioned above are provided in the prior art apparatus, so that a considerably large space is required for arrangement of the number of units, rendering the apparatus bulky. Furthermore, provision of the number of units makes the copying apparatus overly heavy and complicated in construction. The complex construction renders the apparatus liable to invite disorders, leading to an unsatisfactory reliability.

It is accordingly an object of this invention to provide an electrostatic copying apparatus wherein different copying functions are performed by a single unit, thus reducing the number of units required for performing a series of copying functions to make the apparatus small in size, light and simple in construction.

According to this invention, a rotatable drum having a photosensitive layer formed on the circumferential surface makes two complete rotations in order to perform a series of copying functions including at least charging, exposure, development, transfer and cleaning. During the first rotation, charging, exposure and development are performed, with transfer and cleaning being performed during the second rotation. At least the charging and transfer is performed by a charging-transfer combination unit.

Figure 1:
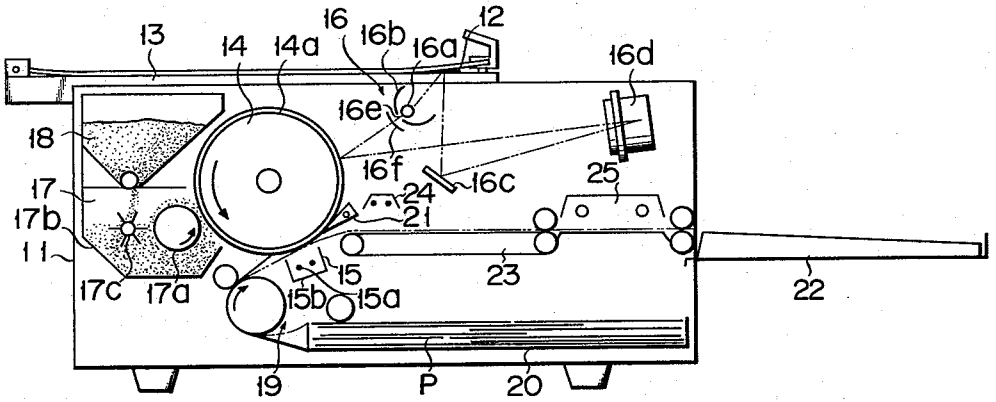
Figure 2:
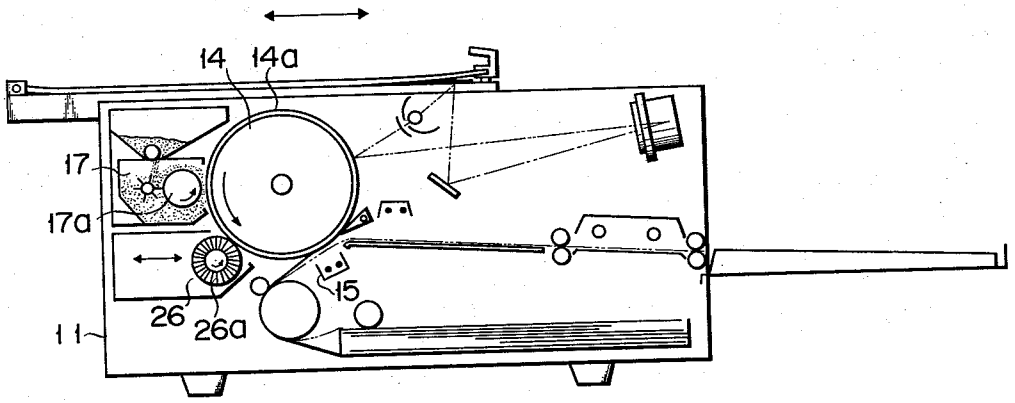

This invention can be more fully understood from the following detailed description when taken in conjunction with the accompanying drawings, in which:

FIG. 1 shows an electrostatic copying apparatus according to one embodiment of this invention; and FIG. 2 shows an electrostatic copying apparatus equipped with an auxiliary cleaning unit according to another embodiment of this invention.

Referring to FIG. 1, an original supporting table 13 supporting an original 12 and capable of reciprocating motion in a horizontal direction is mounted on the upper surface of a body 11 of an electrostatic copying apparatus. About the center of the body 11, is a rotatable drum 14 on the circumferential surface of which a photosensitive layer **14*a* is formed. The drum 14 is driven in the arrowed direction at a peripheral speed equal to the moving speed of the original supporting table 13. A series of copying functions described later are performed during two complete rotations of the drum 14. A charging-transfer combination unit 15, i.e., a unit serving for both charging and transfer purposes, is provided below the rotatable drum 14 in such a manner as to face the photosensitive layer 14*a*. In the first and second rotations of the drum 14, the charging-transfer combination unit 15 performs the charging and transfer functions respectively, among the series of copying functions of charging, exposure, development, transfer, discharge and cleaning. As seen from the drawing, the unit 15 comprises a corona discharge device including a charge wire 15*a* and a shield case 15*b* enclosing the charge wire 15*a***.

An exposure-electrostatic latent image eliminating combination unit 16, i.e., a unit for serving both exposure and electrostatic latent image eliminating purposes, is provided behind the charging-transfer unit 15 relative to the rotation direction of the drum 14 in such a manner as to face the photosensitive layer **14*a*. The unit 16 performs the exposure and electrostatic latent image eliminating, namely discharge, functions in the first and second rotations of the drum 14, respectively, and is constituted by a light source (lamp) 16*a*, a reflector 16*b*, of, for example, C-shape, a mirror 16*c* and a mirror lens 16*d*. The reflector 16*b* encloses the lamp 16*a* in such a manner as to enable the light from the lamp 16*a* to be irradiated to the original 12 supported by the table 13. An opening 16*e* is provided at the bottom of the reflector 16*b* to face the photosensitive layer 14*a* of the rotatable drum 14. Further, a light shutter 16*f* is provided behind the reflector 16*b* to operatively shut the light passageway through the opening 16*e*. The light reflected by the original 12 is further reflected by the mirror 16*c* so as to be irradiated to the mirror lens 16*d* by which the light reflected by the mirror 16*c* is focussed on the photosensitive layer 14*a* of the drum 14**.

A development-cleaning combination unit 17 is provided on the opposite side of the exposure-electrostatic latent image eliminating unit 16 to face the photosensitive layer **14*a* of the drum 14. The unit 17 performs the development and cleaning functions in the first and second rotations of the drum 14, respectively, and comprises a magnetic roller 17*a*, a toner vessel 17*b* receiving a toner which is sucked by a magnetic brush presented by the magnetic roller 17*a* and a stirrer 17*c* for stirring the toner received in the vessel 17*b*. The magnetic roller 17*a* is charged with a bias voltage of a polarity opposite to that of the toner subjected to a triboelectric charging, the absolute value of the bias voltage being smaller at the development step and larger at the cleaning step. It is further seen that a toner hopper 18 is provided above the development-cleaning unit 17**.

Provided below the drum 14 is a paper-feeding unit 19 which serves to take out one by one sheets of copying paper P received in a paper cassette 20 detachably mounted at the bottom of the body 11 of the copying apparatus and send the paper P between the drum 14 and the charging-transfer combination unit 15. A peeling unit 21 for peeling the transferred copying paper from the photosensitive layer **14*a* is provided adjacent to both the charging-transfer combination unit 15 and the rotatable drum 14. The copying paper thus peeled off is transferred into a tray 22 mounted outside the body 11 by a conveying unit 23 provided above the paper cassette 20. A discharge unit 24 composed of, for example, a corona discharge device is provided above unit 23 for removing the charge of the copying paper. Further, a fixing unit 25 is provided along the passageway of the copying paper transferred by unit 23. The fixing unit 25** is constituted by an infrared ray heater device and serves to fix thermally the toner attached to the discharged copying paper to form a pattern corresponding to the pattern of the original.

The electrostatic copying apparatus constructed as described above performs copying functions as described in the following.

When a power switch (not shown) of the apparatus is closed, the infrared ray heater device constituting the fixing device 25 is rendered conducting and heated to a predetermined temperature. A thermoswitch (not shown) serves to open the heater circuit when the predetermined temperature has been reached. At that time, an air-cooling fan (not shown) starts functioning and a ready-lamp (not shown) is lit to indicate a state ready for copying operations. The depression of a print button (not shown) under the state mentioned above causes the rotatable drum 14 to start rotation. When the drum 14 starts its first rotation, the charging-transcription combination unit 15 serves to charge the photosensitive layer 14*a* of the drum at a predetermined potential of a predetermined polarity. At the same time, the original supporting table 13 is moved and the lamp 16*a* of the exposure-electrostatic image eliminating combination unit 16 is lit so as to irradiate the original 12 supported by the table 13. The light reflected by the original 12 is reflected again by the mirror 16*c* and, then, irradiated to the mirror lens 16*d*. Further, the light incident on the mirror lens 16*d* is converged by mirror lens 16*d* onto the phototsensitive layer 14*a* of the drum 14, thereby effecting the exposure on the photosensitive layer 14*a* of an inverted electrostatic latent image corresponding to a pattern of the original 12.

When the drum 14 further rotates to allow the electrostatic latent image thus formed to face the development-cleaning combination unit 17, a magnetic brush formed by the magnetic roller 17*a* to which is applied a low bias voltage (50V to 200V) at that time touches the latent image. As the result, the toner received in the toner vessel 17*b* and charged in a polarity opposite to the polarity of the latent image is attached to the latent image, rendering visible the latent image. Namely, the development is performed.

The rotatable drum 14 then makes the second rotation. In response to the start of the second rotation, the paper-feeding unit 19 serves to send the uppermost sheet of the copying paper received in the paper cassette 20 between the photosensitive layer 14*a* and the charging-transfer combination unit 15. At this stage, the corona discharge device constituting the unit 15 is charged to the same potential and the polarity as the photosensitive layer 14*a* and, thus, is ready for the transfer operation. It follows that the inverted visible image formed by the toner on the photosensitive layer 14*a* is transferred onto the copying paper as the normal image when the copying paper has passed between the photosensitive layer 14*a* and the charging-transfer combination unit 15.

After the transfer, the copying paper is peeled off the photosensitive layer 14*a* by the peeling unit 21 and transferred by unit 23 into the tray 22. In the course of the transfer, the charge of the copied paper is removed by the discharge unit 24 and, then, the normal image of the paper is fixed by the fixing unit 25.

During the second rotation of the drum 14, the light shutter 16*f* of the exposure electrostatic latent image eliminating combination unit 16 moves to open the opening 16*e* of the reflector 16*b*, thereby permitting the light from the lamp 16*a* to be irradiated through the opening 16*e* to the photosensitive layer 14*a*. As a result, the charge of the electrostatic latent image remaining on the photosensitive layer 14*a* after the transfer is eliminated. At this stage, the magnetic roller 17*a* of the development-cleaning combination unit 17 is impressed with a high bias voltage (200V to 800V) to form a magnetic brush. The magnetic brush thus formed touches the residual toner on the photosensitive layer whose potential has been dropped to zero level by the function of the unit 16 and pulls it so as to effect cleaning of the photosensitive layer. It should be noted in this connection that the cleaning function starts just before the completion of the second rotation of the drum, resulting in an insufficient cleaning at the completion time of the second rotation. Accordingly, the drum is allowed to make one additional rotation for a sufficient cleaning of the photosensitive layer. In this case, however, the original supporting table 13, which has been brought back to its rest position just before the completion of the second rotation of the drum, remains at rest in spite of the third rotation of the drum. After the third rotation of the drum, cleaning of the photosensitive layer 14*a* has been finished and the drum stops its rotation and remains at rest until the next depression of the print button.

The above description covers the case where the copying is made onto only one sheet of copying paper. Where the copying is made onto a plurality of sheets, the cleaning is effected during the first rotation of the drum for the succeeding copying operation. In other words the cleaning corresponding to that effected during the third rotation of the drum is carried out during the charing and transfer steps for the succeeding copying operation and, when the copying operation for the final sheet has been finished, the drum is allowed to make one additional rotation for the cleaning of the photosensitive layer.

In the embodiment described, the cleaning of the photosensitive layer is carried out by utilizing the magnetic roller 17*a* of the development-cleaning combination unit 17. But, in some cases the cleaning with the development-cleaning combination unit 17 is not sufficient.

FIG. 2 shows another embodiment of this invention, in whcih an auxiliary cleaning unit 26 is provided for improvement of the cleaning function of the apparatus. As seen from the drawing the auxiliary cleaning unit 26 comprising a rotatable brush 26*a* is provided adjacent to the rotatable drum 14 and between the development-cleaning combination unit 17 and the charging-transcription combination unit 15. During the first rotation of the drum 14, the auxiliary cleaning unit 26 stands apart from the photosensitive layer 14*a* and is brought into contact with the photosensitive layer during the second rotation of the drum. The residual toner attached to the photosensitive layer 14*a* after the cleaning by the development-cleaning combination unit 17 is almost perfectly removed from the layer 14*a* by the auxiliary cleaning unit 26. Except for the provision of the auxiliary cleaning unit 26, the apparatus shown in FIG. 2 is just the same as that shown in FIG. 1 in construction and function.

Each of the embodiments shown in FIGS. 1 and 2 utilizes three combination units, i.e., a charging-transfer unit, an exposure-electrostatic latent image eliminating unit and a development-cleaning unit. But, it is allright to use a combination unit for charging-transfer alone, with the other units for exposure, electrostatic latent image eliminating, development, and cleaning provided separately. Alternatively, a charging-transfer unit and a development-cleaning unit may be used with an exposure unit and an electrostatic latent image eliminating unit provided separately.

In the embodiments described, the magnetic roller 17*a* of the development-cleaning combination unit 17 is impressed with different levels of bias voltage between the development and cleaning steps. But, the same level of bias voltage may be applied to the magnetic roller 17*a*.

As described in detail, the rotatable drum of the electrostatic copying apparatus according to this invention makes two complete rotations for effecting a series of copying functions, the functions of charging, exposure and development being performed during the first rotation and transfer, electrostatic image eliminating and cleaning during the second rotation. This construction permits combining units for the first and second rotations of the drum, for example a charging unit and a transfer unit, into a single unit, resulting in the reduction of the number of required units which are to be incorporated into the apparatus. Obviously, the apparatus thus constructed is made small in size, light and simplified in construction, leading to a low manufacturing cost. In addition, a simplified construction decreases disorder occurrences, presenting an advantage in terms of the maintenance of the apparatus.

What we claim is:

1. An electrostatic copying apparatus for performing a series of copying functions including charging for charging a photosenstiive layer, exposure for forming an electrostatic latent image corresponding to the pattern of an original on the charged photosensitive layer, development for turning the electrostatic latent image formed on the photosensitive layer to a visible image, transfer for transferring the visible image formed on the photosensitive layer to a copying paper, and cleaning for cleaning the photosensitive layer after the transfer; the copying apparatus comprising a rotatable drum on the circumferential surface of which the photosensitive layer is formed and which makes two rotations for performing the series of the copying functions, a charging-transfer combination unit for charging the photosensitive layer in the first rotation of the rotatable drum and performing transfer in the second rotation, said combination unit facing the photosensitive layer of the rotatable drum, an exposure unit performing the exposure function and facing the photosensitive layer of the rotatable drum, a development unit performing the development function and facing the photosensitive layer of the rotatable drum, and a cleaning unit performing the cleaning function and facing the photosensitive layer of the rotatable drum.

2. An electrostatic copying apparatus according to claim 1 which further comprises an auxiliary cleaning unit including a rotatable brush disposed downward of the development unit relative to the rotational direction of the rotatable drum, said auxiliary cleaning unit operatively contacting and separating from the photosensitive layer of the rotatable drum during the operation of the copying apparatus.

3. An electrostatic copying apparatus according to claim 1 wherein the charging-transfer combination unit comprises a corona discharge device discharging corona of the same polarity and potential for both the charging and transfer functions.

4. An electrostatic copying apparatus for performing a series of copying functions including at least charging for charging a photosensitive layer, exposure for forming an electrostatic latent image corresponding to the pattern of an original on the charged photosensitive layer, development for turning the electrostatic latent image formed on the photosensitive layer to a visible image, transfer for transferring the visible image formed on the photosensitive layer onto a copying paper, eliminating the electrostatic latent image after the transfer and cleaning for cleaning the photosensitive layer after the elimination of the latent image; the copying apparatus comprising a rotatable drum on the circumferential surface of which the photosensitive layer is formed and which makes two rotations for performing the series of the copying functions, a charging-transfer combination unit including means impressed with a voltage of a predetermined level for performing the charging in the first rotation of the rotatable drum and the transfer in the second rotation, said charging-transfer combination unit facing the photosensitive layer of the rotatable drum, an exposure unit performing the exposure in the first rotation of the rotatable drum and facing the photosensitive layer of the rotatable drum, a unit discharging the photosensitive layer for eliminating the electrostatic latent image after the transfer and a development-cleaning combination unit including means for receiving developing powder and means for forming an electromagnetic brush for performing the development in the first rotation of the rotatable drum and the cleaning in the second rotation, said development-cleaning combination unit facing the photosensitive layer of the rotatable drum.

5. An electrostatic copying apparatus according to claim 4 which further includes an auxiliary cleaning unit composed of a rotatable brush disposed downward of the development-cleaning unit relative to the rotational direction of the rotatable drum, said auxiliary cleaning unit contacting and separating from the photosensitive layer of the rotatable drum during the operation of the copying apparatus.

6. An electrostatic copying apparatus according to claim 4 wherein the charging-transfer combination unit comprises a corona discharge device discharging corona of the same polarity and potential for both the charging and transfer functions.

7. An electrostatic copying apparatus according to claim 4 wherein the development-cleaning combination unit comprises a magnetic roller disposed adjacent to the photosensitive layer of the rotatable drum and impressed with a low bias voltage in the development step and with a high bias voltage in the cleaning step to form a magnetic brush.

8. An electrostatic copying apparatus for performing a series of copying functions including at least charging for charging a photosensitive layer, exposure for forming on the photosensitive layer an electrostatic latent image corresponding to the image of an original, development for turning the electrostatic latent image formed on the photosensitive layer to a visible image, transfer for transferring the visible image formed on the photosensitive layer onto a copying paper, eliminating the electrostatic latent image after the transfer and cleaning for cleaning the photosensitive layer; the copying apparatus comprising a rotatable drum on the circumferential surface of which the photosensitive layer is formed and which makes two rotations for performing the series of the copying functions, a charging-transfer combination unit having means impressed with a voltage of a predetermined level for performing the charging in the first rotation of the rotatable drum and the transfer in the second rotation, said charging-transfer combination unit facing the photosensitive layer of the rotatable drum, an exposure-electrostatic latent image eliminating combination unit having a single optical means for performing the exposure in the first rotation of the rotatable drum to form the latent image on the rotatable drum and means for directing operatingly the light from said single optical means to the photosensitive layer to eliminate the latent image of the photosensitive layer after the transfer in the second rotation of the rotatable drum, said exposure-electrostatic latent image eliminating unit facing the photosensitive layer of the rotatable drum and a development-cleaning combination unit including means for attaching toner to the electrostatic latent image for the development purpose in the first rotation of the rotatable drum and for electrostatically pulling the residual toner attached to the photosensitive layer for the cleaning purpose after the elimination of the latent image in the second rotation of the rotatable drum, said development-cleaning combination unit facing the photosensitive layer of the rotatable drum.

9. An electrostatic copying apparatus according to claim 8, which further comprises an auxiliary cleaning unit including a rotatable brush disposed downward of the development-cleaning combination unit relative to the rotational direction of the rotatable drum, said auxiliary cleaning unit operatively contacting and separating from the photosensitive layer of the rotatable drum during the operation of the copying apparatus.

10. An electrostatic copying apparatus according to claim 8, wherein the exposure-electrostatic latent image eliminating combination unit comprises a lamp for irradiating light to the original, a reflector for reflecting the light from the lamp to the original and having an opening at the bottom, said opening facing the photosensitive layer, a light shutter operativly shutting the light coming through the opening onto the photosensitive layer, and an optical unit converging the light reflected from the original onto the photosensitive layer of the rotatable drum.

11. An electrostatic copying apparatus according to claim 8, wherein the development-cleaning combination unit comprises a magnetic roller disposed adjacent to the photosensitive layer of the rotatable drum and impressed with a low bias voltage in the development step and with a high bias voltage in the cleaning step to provide a magnetic brush.

12. An electrostatic copying apparatus according to claim 8, wherein the charging-transfer combination unit comprises a corona discharge device discharging corona of the same polarity and potential for both the charging and transfer functions.

* * * * *

Notice of Adverse Decision in Interference

In Interference No. 100,681, involving Patent No. 4,087,170, E. Sawaoka and S. Hashimoto, ELECTROSTATIC COPYING APPARATUS WITH COMBINED CHARGING TRANSFER UNIT, final judgment adverse to the patentees was rendered July 9, 1982, as to claims 1, 3, 4, 6, 7, 11 and 12.

[*Official Gazette November 9, 1982.*]